US010317066B2

(12) United States Patent
Mathews et al.

(10) Patent No.: US 10,317,066 B2
(45) Date of Patent: Jun. 11, 2019

(54) RECESSSED DOWNLIGHT FIXTURE WITH HEATSINK

(71) Applicant: LUCIFER LIGHTING COMPANY, San Antonio, TX (US)

(72) Inventors: Ben Mathews, San Antonio, TX (US); Chris Reed, Reno, NV (US)

(73) Assignee: Lucifer Lighting Company, San Antonio, TX (US)

( * ) Notice: Subject to any disclaimer, the term of this patent is extended or adjusted under 35 U.S.C. 154(b) by 77 days.

(21) Appl. No.: 15/497,200

(22) Filed: Apr. 25, 2017

(65) Prior Publication Data

US 2017/0307201 A1 Oct. 26, 2017

Related U.S. Application Data

(60) Provisional application No. 62/327,423, filed on Apr. 25, 2016.

(51) Int. Cl.
*F21V 15/01* (2006.01)
*F21V 29/70* (2015.01)
(Continued)

(52) U.S. Cl.
CPC ..... *F21V 29/70* (2015.01); *F21S 8/026* (2013.01); *F21V 7/00* (2013.01); *F21V 19/003* (2013.01);
(Continued)

(58) Field of Classification Search
CPC ..... F21S 8/026; F21V 15/01; F21V 15/017; F21V 15/012; F21V 29/503; F21V 29/70; F21V 29/71; F21V 29/713; F21V 29/85
See application file for complete search history.

(56) References Cited

U.S. PATENT DOCUMENTS 2,639,368 A * 5/1953 Pryne ..... F21S 8/02 16/259
2,716,185 A * 8/1955 Burliuk ..... F21S 8/026 362/364
(Continued)

FOREIGN PATENT DOCUMENTS

| | | |
|---|---|---|
| CA | 2765289 | 7/2013 |
| CN | 104315386 | 1/2015 |
| EP | 2189709 | 5/2010 |

OTHER PUBLICATIONS

Archlighting.com. (2018). Cite a Website—Cite This for Me. [online] Available at: http://www.archlighting.com/technology/keeping-it-cool-with-innovative-heat-sink-designs_o [Accessed Feb. 23, 2018].
(Continued)

*Primary Examiner* — Ismael Negron
(74) *Attorney, Agent, or Firm* — Norton Rose Fulbright US LLP

(57) ABSTRACT

A downlight includes a housing having a thermally-conductive upper wall, a lower wall defining an aperture, and a sidewall extending between the upper wall and the lower wall, where a majority, by weight, of the upper wall includes a first material, and a majority, by weight, of the sidewall includes a second material that is different than the first material; and a light fixture configured to be coupled to the housing such that a light source of the light fixture is adjacent to and in thermal communication with the upper wall.

20 Claims, 7 Drawing Sheets

(51) Int. Cl.

| | |
|---|---|
| ***F21V 7/00*** | (2006.01) |
| ***F21V 29/89*** | (2015.01) |
| ***F21S 8/02*** | (2006.01) |
| ***F21V 21/14*** | (2006.01) |
| ***F21V 19/00*** | (2006.01) |
| ***F21V 23/00*** | (2015.01) |
| *F21Y 115/10* | (2016.01) |

(52) U.S. Cl.
CPC ..... *F21V 21/14* (2013.01); *F21V 23/003* (2013.01); *F21V 29/89* (2015.01); *F21Y 2115/10* (2016.08)

(56) References Cited

U.S. PATENT DOCUMENTS 2,802,933 A * 8/1957 Broadwin ..... F21V 21/04 248/327
4,336,575 A * 6/1982 Gilman ..... F21V 21/04 248/27.1
4,400,673 A * 8/1983 Gilman ..... H01H 37/5436 315/119
5,440,471 A * 8/1995 Zadeh ..... F21V 23/02 362/147
5,457,617 A * 10/1995 Chan ..... F21S 8/02 362/148
5,597,234 A * 1/1997 Winkelhake ..... F21S 8/02 362/364
5,836,678 A * 11/1998 Wright ..... F21S 8/02 362/364
6,176,599 B1 * 1/2001 Farzen ..... F21S 8/026 362/145
6,632,006 B1 * 10/2003 Rippel ..... F21S 8/02 362/147
7,320,536 B2 * 1/2008 Petrakis ..... F21S 8/02 362/147
7,682,054 B2 3/2010 Hsu et al.
7,862,214 B2 * 1/2011 Trott ..... F21S 8/026 362/365
8,033,687 B2 10/2011 Wang
8,425,085 B2 4/2013 Van Laanen
8,540,402 B2 9/2013 Guercio et al.
8,557,905 B2 10/2013 Shimokoba et al.
8,926,145 B2 1/2015 Lynch et al.
2009/0034261 A1 2/2009 Grove
2012/0044695 A1 2/2012 Yen
2012/0155095 A1 6/2012 Ryan, Jr.
2012/0324772 A1 12/2012 Gingerella
2014/0268801 A1 9/2014 Madden et al.
2015/0198324 A1 7/2015 O'Brien et al.

OTHER PUBLICATIONS

Dong & Narendran, "Understanding Heat Transfer Mechanisms in Recessed LED Luminaires." *Society of Photo-Optical Instrumentation Engineers,* International Conference on Solid State Lighting Proceedings, 74220V. (2009).
Luciferlighting.com. (2018). Lucifer Lighting—CY3-AD Adjustable LED Cylinder. [online] Available at: http://www.luciferlighting.com/Products/Surface-Mount/CY3-LED-Cylinder [Accessed Feb. 23, 2018].

* cited by examiner

RECESSSED DOWNLIGHT FIXTURE WITH HEATSINK

CROSS-REFERENCE TO RELATED APPLICATIONS

This application claims priority to U.S. Provisional Application No. 62/327,423, filed Apr. 25, 2016, which is incorporated by reference herein in its entirety.

BACKGROUND

1. Field of Invention

The present invention relates generally to light assemblies, and more specifically, but not by way of limitation, to recessed downlights.

2. Description of Related Art

In modern building designs, there is tremendous pressure to reduce floor-to-floor height in order to reduce construction costs. A few centimeters saved per floor can add up to large savings in the cost of the building, including its core components and cladding. One area where floor-to-floor height can be reduced is in the plenum space, which is the above-ceiling space in buildings where lighting fixtures, ductwork, sprinkler piping, wiring, and/or the like can be disposed.

Downlights are designed to be recessed into a ceiling and typically are installed such that they extend into the plenum space. Thus, reducing the height of a downlight can allow for corresponding reductions in floor-to-floor height. Existing downlights include heatsinks designed to dissipate heat from their light sources. Such heatsinks may have increased importance for light-emitting diode (LED) light sources; for example, failure to sufficiently dissipate heat from an LED light source can damage LED phosphor, resulting in lower light output, changes in color, and/or decreases in life expectancy, particularly if the LED light source is receiving 350 or more milliamps (mA). For at least these reasons, a typical downlight includes a relatively large, bulky, and finned heat sink, which adds centimeters to the overall height of the downlight.

SUMMARY

Some embodiments of the present disclosure are downlights that comprise a housing with at least one wall that serves as a heatsink. To illustrate, a light fixture can be disposed within the housing such that the light fixture is adjacent to and in thermal communication with the wall. In at least this way, the wall of the housing can eliminate the need for a traditional heatsink, thereby reducing the height of the downlight.

Some embodiments of the present downlights comprise: a housing including a thermally-conductive upper wall, a lower wall that defines an aperture, and a sidewall extending between the thermally-conductive upper wall and the lower wall, and a light fixture comprising or configured to receive a light source, where the light fixture is configured to be coupled to the housing such that the light source (when coupled to the light fixture) is adjacent to and in thermal communication with the thermally-conductive upper wall.

In some downlights, the light fixture is configured to be coupled to the housing such that the light source is within 20, 15, 10, or 5 millimeters (mm) of the thermally-conductive upper wall. In some downlights, the light fixture is configured to be coupled to the housing such that no portion of the light fixture extends vertically beyond the thermally-conductive upper wall. Some downlights comprise a thermally-conductive mounting plate configured to be coupled between the light fixture and the thermally-conductive upper wall.

In some downlights, the thermally-conductive upper wall is removably coupled to the sidewall. In some downlights, the thermally-conductive upper wall has a first maximum thickness, and the sidewall has a second maximum thickness that is smaller than the first maximum thickness. In some downlights, the first maximum thickness is at least 125, 150, 175, 200, 225, 250, 275, 300, 325, or 350% of the second maximum thickness. In some downlights, the upper wall has a maximum thickness of at least 0.2 centimeters (cm) and less than 0.6 cm.

In some downlights, a majority, by weight, of the thermally-conductive upper wall comprises a first material, and a majority, by weight, of the sidewall comprises a second material that is different than the first material. In some downlights, the upper wall comprises aluminum, copper, silver, gold, and/or a thermally-conductive polymer.

In some downlights, a maximum vertical distance between the lower wall and the thermally-conductive upper wall is less than 100, 95, 90, 85, 80, 75, 70, 65, 60, 55 or 50 mm. In some downlights, a maximum transverse dimension of the thermally-conductive upper wall is at least 4, 5, 6, 7, 8, 9, or 10 times a maximum transverse dimension of the light source. In some downlights, a maximum transverse dimension of the housing is at least 1.25, 1.50, 1.75, 2.00, 2.25, 2.50, or 2.75 times a maximum transverse dimension of the aperture. In some downlights, opposing portions of the sidewall are parallel to one another. In some downlights, the sidewall defines one or more openings.

In some downlights, the light source has a maximum rated current of at least 500 mA. In some downlights, the light fixture comprises a reflector configured to direct light from the light source and through the aperture. In some downlights, the light fixture is configured to be coupled to the housing such that the reflector is spaced apart from the sidewall.

Some downlights comprise a baffle having an upper end and a lower end, the baffle defining an interior channel extending between the upper end and the lower end, where the baffle is configured to be coupled to the housing such that the upper end of the baffle extends through the aperture. In some downlights, the baffle is configured to be coupled to the housing such that the upper end of the baffle is spaced apart from the reflector. Some downlights comprise a lens or a diffuser configured to be coupled to the upper end of the baffle.

Other embodiments include methods of installing a downlight or replacing a light source or a light fixture of the downlight.

The term "coupled" is defined as connected, although not necessarily directly, and not necessarily mechanically; two items that are "coupled" may be unitary with each other. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent. The terms "a" and "an" are defined as one or more unless this disclosure explicitly requires otherwise. Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those one or more elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION

Figure 1:
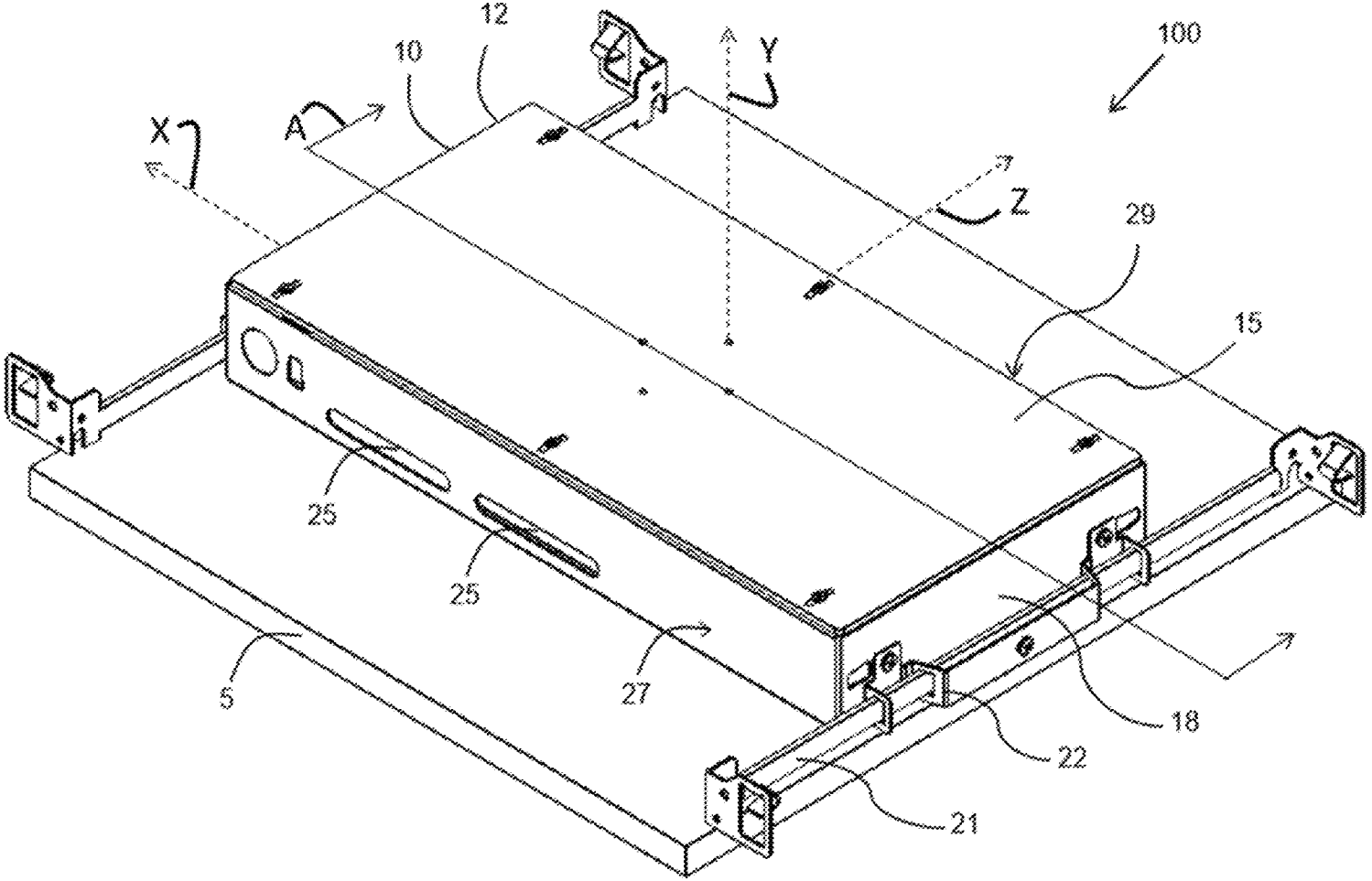
FIG. 1 is a perspective view of an embodiment of the present downlights.
Figure 2:
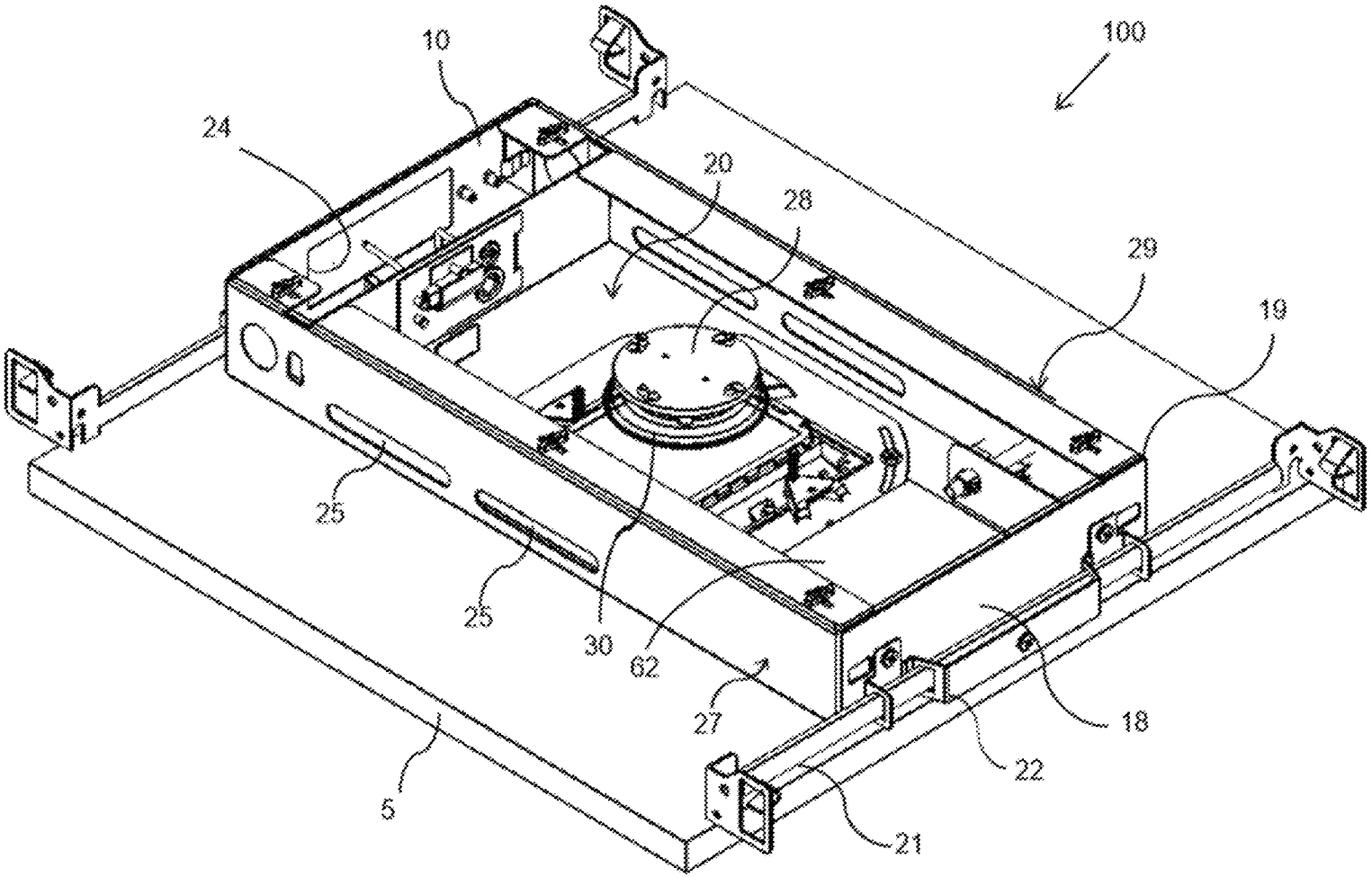
FIG. 2 is a perspective view of the downlight of FIG. 1 with a transparent upper wall to permit viewing of interior components.

FIGS. 1-6 show an embodiment 100 of a downlight. Downlight 100 is a type of light assembly that is configured to be recessed into a structure 5, such as, for example, a ceiling, wall, floor, or the like. Downlight 100 can comprise a housing 10 and a light fixture 30 that is disposable within the housing and comprises, or is configured to receive, a light source 32. For example, housing 10 comprises walls (e.g., an upper wall 12, a lower wall 14, and a sidewall 18 that extends between the upper and lower walls) that define an interior volume 20 within which light fixture 30 can be disposed. As described below, at least one of the walls (e.g., upper wall 12) is configured to be in thermal communication with light source 32 such that the wall functions as a heat sink for the light source. Such a wall can be thermally-conductive. Such a wall can be flat (e.g., planar, finless), which can reduce a space occupied by housing 10. As used herein, two components are in "thermal communication" when they are coupled to one another such that heat can be conducted between the two components. Such a coupling can be via one or more thermally-conductive components that are disposed between the two components (e.g., mounting plate 28, described below) or one in which the two components are in contact with one another.

Figure 3:
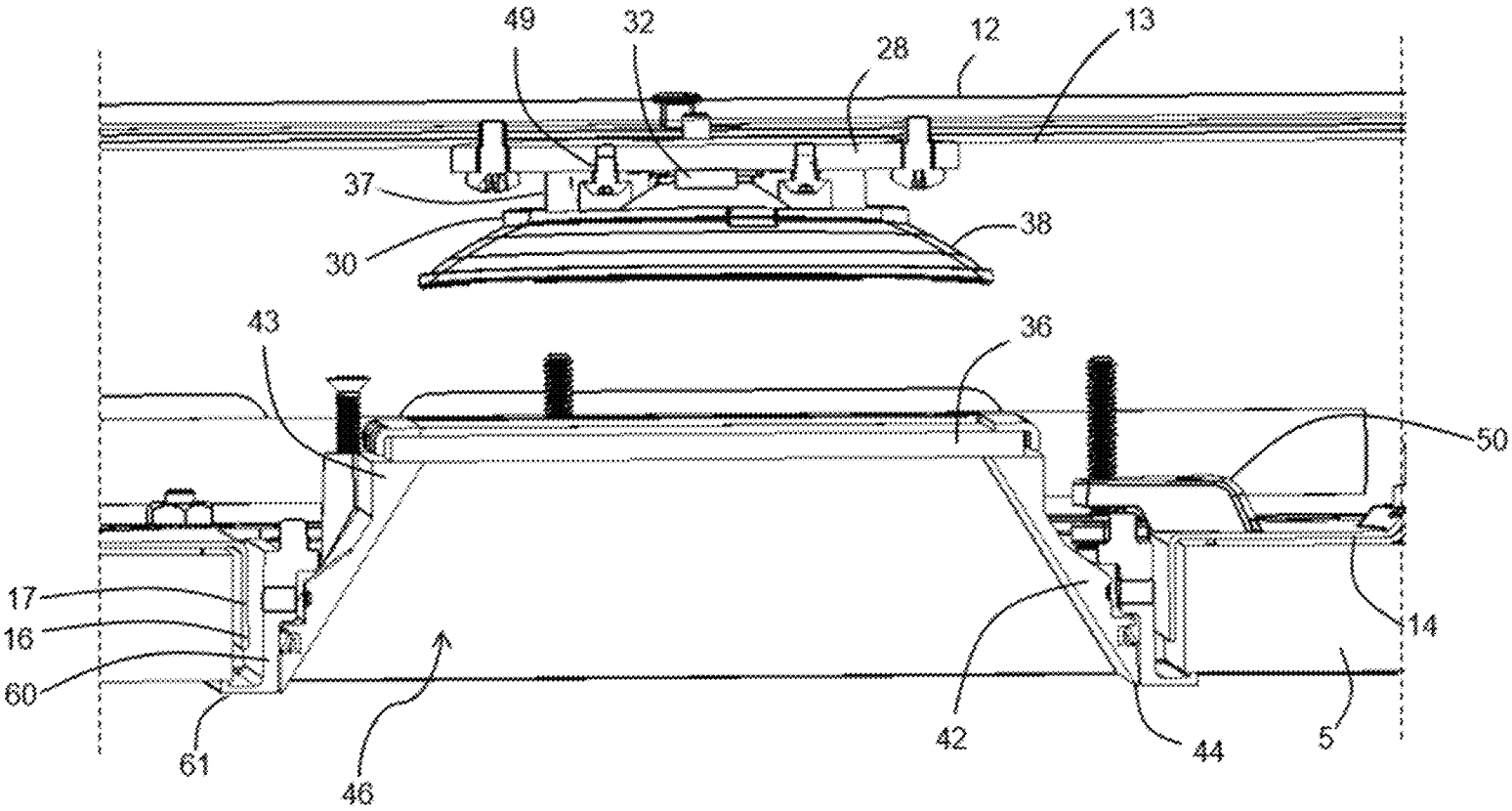
FIG. 3 is a cross-sectional side view of the downlight of FIG. 1, taken along line A of FIG. 1.
Figure 4:
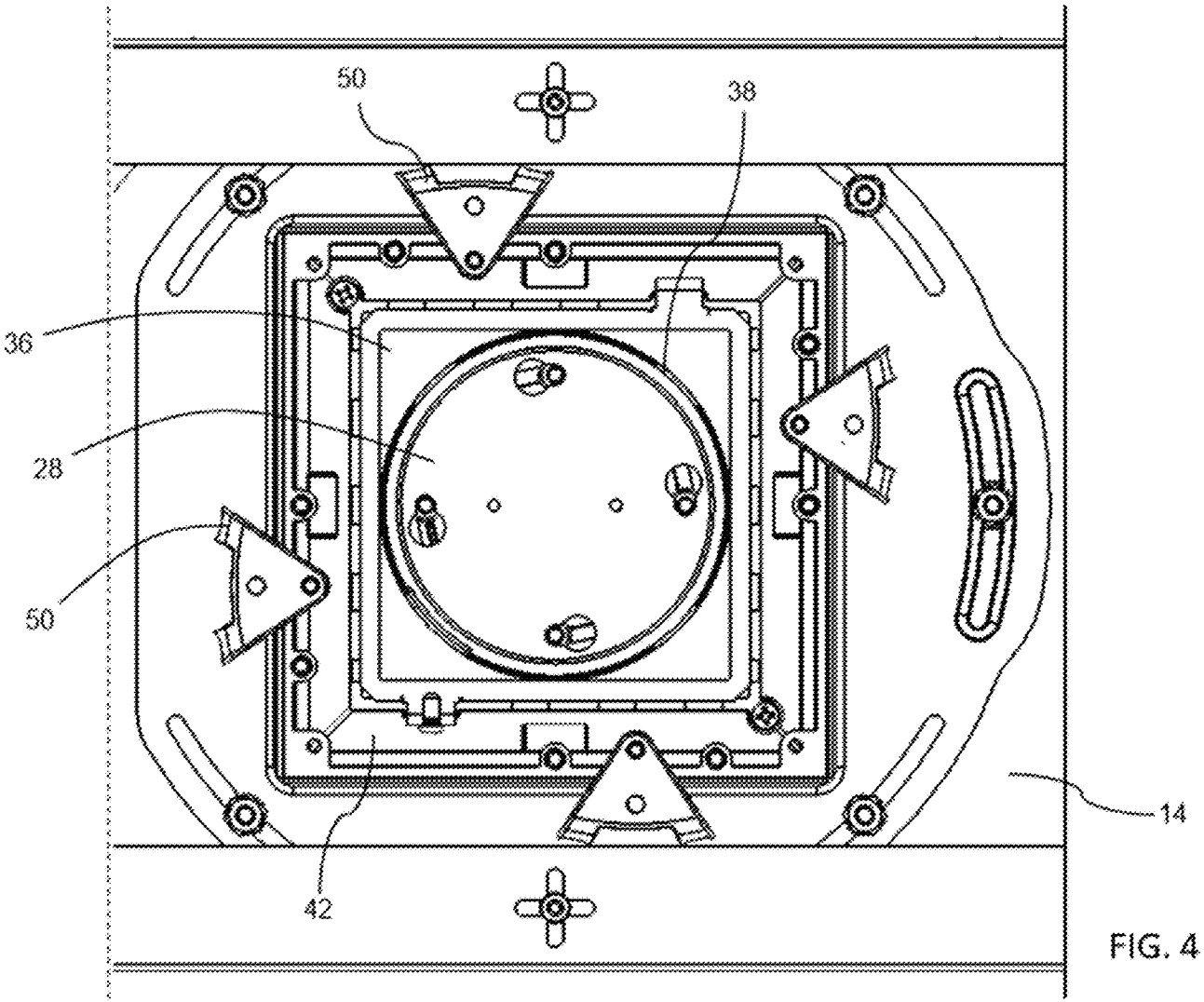
FIG. 4 is a top view of the downlight of FIG. 1.
Figure 5:
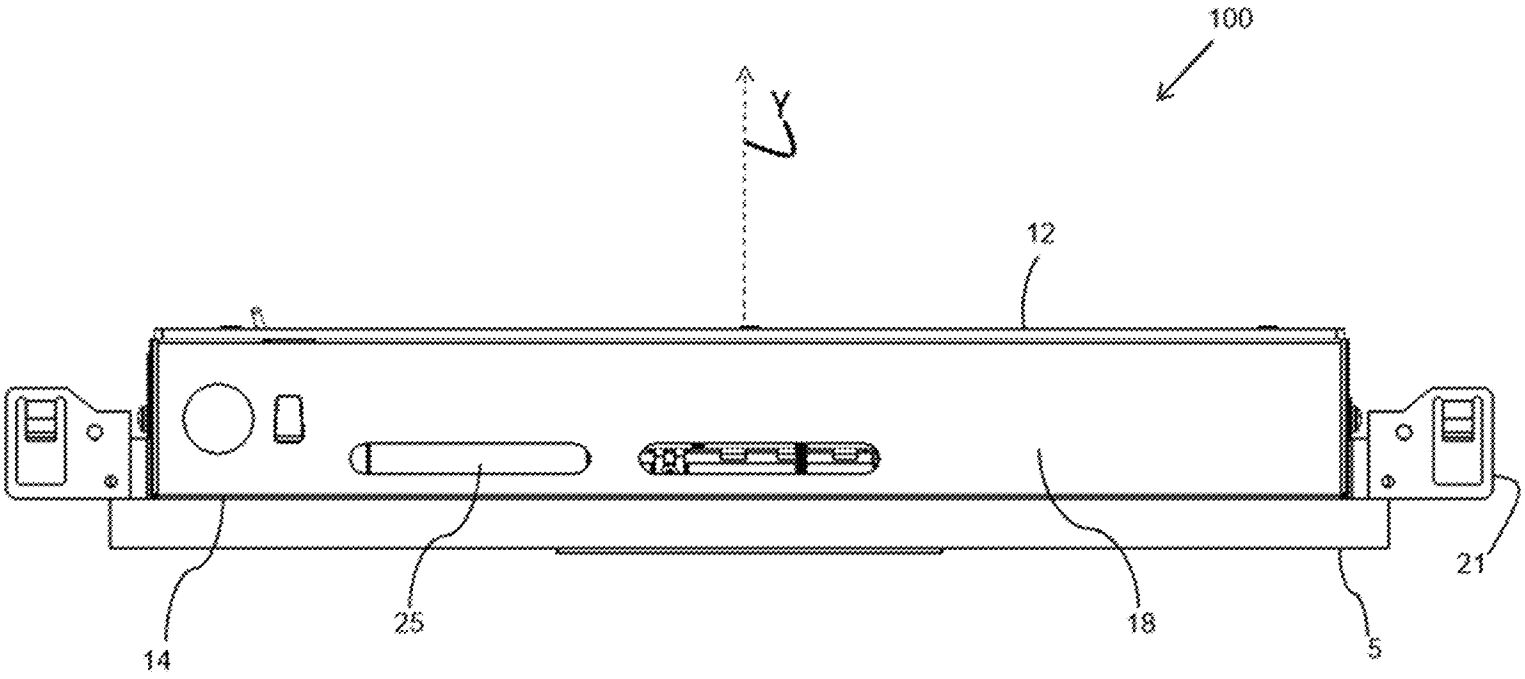
FIG. 5 is a side view of the downlight of FIG. 1.
Figure 6:
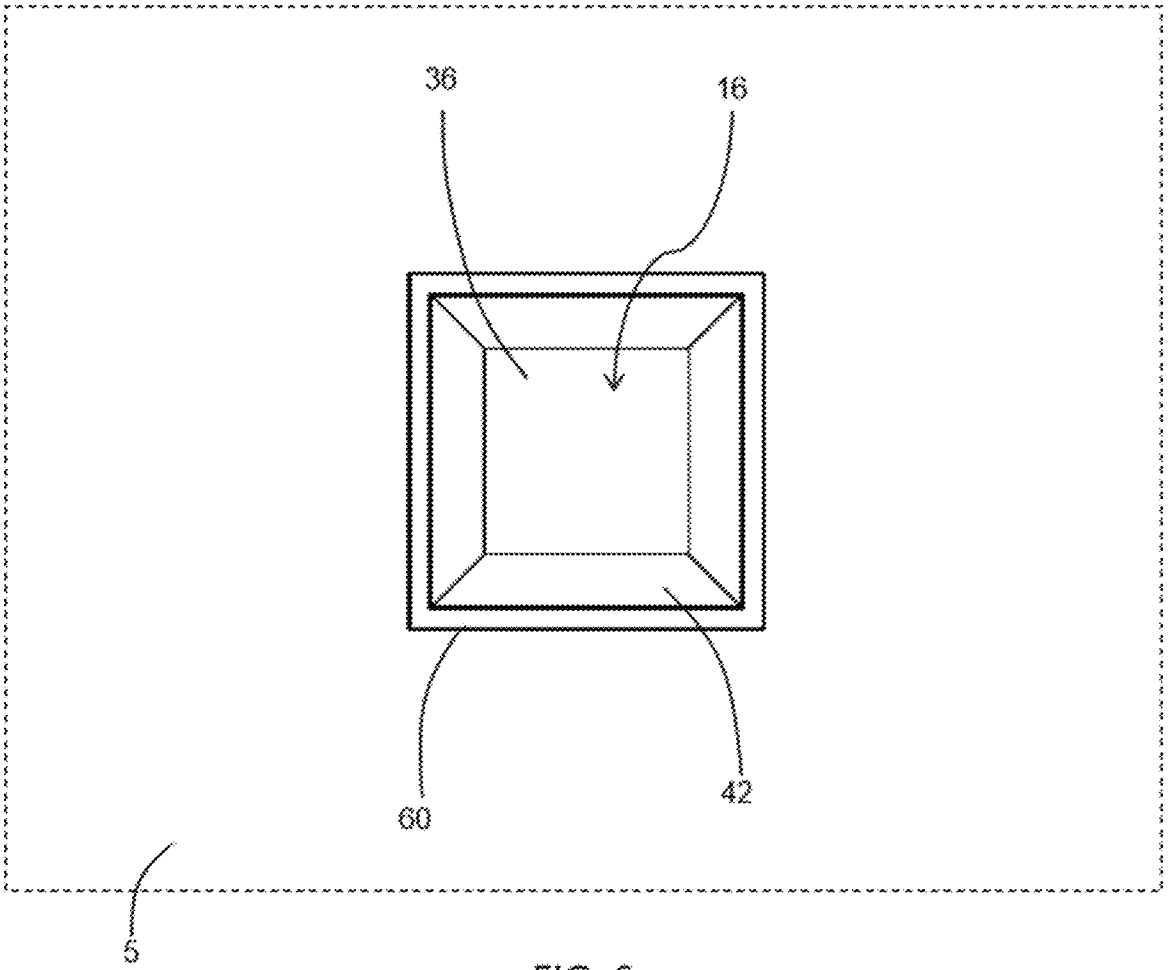
FIG. 6 depicts the downlight of FIG. 1 recessed into a ceiling.

In the embodiment shown, upper wall 12 is removably coupled to sidewall 18 (e.g., via one or more fasteners), which can facilitate installation and removal of components within interior volume 20. Lower wall 14 can define an aperture 16 (FIGS. 3 and 6). More particularly, aperture 16 can be defined by a downwardly-extending flange 17 of the lower wall. Aperture 16 can be located on lower wall 14 directly below the portion of upper wall 12 to which light fixture 30 is mountable such that light emitted from the light fixture is directed through the aperture. In this embodiment, at least a portion of upper wall 12 and at least a portion of lower wall 14 can be parallel to one another. Similarly, opposing portions of sidewall 18 (e.g., on front and back sides of the sidewall and/or on left and right sides of the sidewall) can be parallel to one another.

Downlight 100 can include one or more brackets 22 coupled to housing 10 for securing the housing relative to structure 5. As shown, each of the one or more brackets can be coupled to sidewall 18. One or more brackets 22 can each be coupled to a hangar bar 21, which may be length-adjustable, that is configured to be coupled to a support structure.

Housing 10 can define one or more openings, such as openings 24 and 25, that provide access to interior volume 20 from an exterior of the housing. To illustrate, sidewall 18 can define an opening 24 that is sized and shaped to permit wiring to extend through the opening, such as wiring for supplying power to light fixture 30. To further illustrate, sidewall 18 can define one or more openings 25 (e.g., two openings 25 on its front side 27 and two openings 25 on its rear side 29) for permitting airflow through the housing.

Housing 10 can be low-profile. For example, a maximum vertical distance (measured along the Y-axis, FIG. 1) between lower wall 14 and upper wall 12 can be less than or equal to any one of, or between any two of: 100, 95, 90, 85, 80, 75, 70, 65, 60, 55, or 50 mm (e.g., less than 60, 55, or 50 mm). In at least this way, a space above structure 5 required for installing downlight 100 can be reduced. As described below, such functionality can be facilitated by at least one wall (e.g., upper wall 18) of housing 10 serving as a heat sink for light source 32, eliminating the need for a traditional, space consuming heat sink to be disposed within or coupled to the housing.

In this embodiment, upper wall 12 is configured to serve as a heat sink for light source 32. Upper wall 12 can have a different thickness than that of other housing walls, such as lower wall 14 and/or sidewall 18. For example, upper wall 12 can have a maximum thickness that is greater than a maximum thickness of sidewall 18. More particularly, the maximum thickness of upper wall 12 can be greater than or equal to any one of, or between any two of: 125, 150, 175, 200, 225, 250, 275, 300, 325, or 350% (e.g., at least 125%)

of the maximum thickness of sidewall 18. The maximum thickness of upper wall 12 can be between 2.5 mm and 10.0 mm. The thickness of upper wall 12 can be substantially constant (e.g., not varying by more than 10%). Upper wall 12 can be flat (e.g., planar, finless). For example, upper wall 12 has a lower surface 13 (facing interior volume 20 when the upper wall is coupled to sidewall 18) and an upper surface 15 opposite the lower surface, each of which can be flat.

Upper wall 12 can comprise a thermally-conductive material, such as, for example, aluminum, copper, silver, gold, a thermally-conductive polymer, and/or the like. A thermally-conductive material can have a thermal conductivity that is greater than or equal to any one of, or between any two of: 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, or 400 $W \cdot m^{-1} \cdot K^{-1}$ (e.g., at least 200 $W \cdot m^{-1} \cdot K^{-1}$). Upper wall 12 can comprise a different material than that of other housing walls, such as lower wall 14 and/or sidewall 18. For example, a majority, by weight, of upper wall 12 can comprise a first material, and a majority, by weight, of sidewall 18 can comprise a second material that is different than the first material. In embodiments where other wall(s) of a housing (e.g., 10) (e.g., a lower wall 14 and/or sidewalls 18) are configured to serve as a heat sink for a light source (e.g., 32), the other wall(s) can include one or more of the features described above for upper wall 12.

Upper wall 12 can be dimensioned (e.g., in length and width) to facilitate the upper wall in conducting heat away from light source 32. For example, a maximum transverse dimension (measured along axis X or axis Z, FIG. 1) of upper wall 12 can be greater than or equal to any one of, or between any two of: 4, 5, 6, 7, 8, 9, 10, 15, 20, 25, 30, 35, or 40 times (e.g., at least 4 times) a maximum transverse dimension (measured along axis X or axis Z) of light source 32. To illustrate, if light source 32 is an LED light source, the maximum transverse dimension of the light source may be the maximum transverse dimension of a circuit board to which LED(s) of the light source are mounted. For further example, upper wall 12 (e.g., lower surface 13 and/or upper surface 15 thereof) can have a surface area that is greater than any one of, or between any two of: 50, 55, 60, 65, 70, or 75 $cm^2$ per watt of light source 32.

A maximum transverse dimension (measured along axis X or axis Z) of housing 10 can be greater than or equal to any one of, or between any two of: 1.25, 1.50, 1.75, 2.00, 2.25, 2.50, or 2.75 times (e.g., at least 1.25 times) a maximum transverse dimension (measured along axis X or axis Z) of aperture 16. Upper wall 12 can have dimensions (e.g., length and/or width) that are substantially equal to corresponding dimensions of housing 10. For example, when upper wall 12 is coupled to sidewall 18, the upper wall can overlie substantially all of an upper edge 19 of the sidewall.

Light fixture 30 can comprise, or be configured to receive, a light source 32. When light source 32 is coupled to light fixture 30 and the light fixture is disposed within housing 10, light emitted from the light source can be directed toward lower wall 14 and through aperture 16. Light source 32 can be any suitable light source, whether electroluminescent (e.g., light-emitting diode(s)), fluorescent (e.g., fluorescent tube(s)), incandescent (e.g., incandescent light bulbs(s)), and/or the like. For example, in this embodiment, light source 32 is an LED light source.

In this embodiment, light fixture 30 is configured to be coupled to housing 10 such that light source 32 is in thermal communication with upper wall 12, thereby allowing the upper wall to function as a heat sink for the light source. For example, when light fixture 30 is coupled to housing 10, light source 32 can be adjacent to upper wall 12, meaning the light source is within 20, 15, 10, 5, 3, or 2 mm of the upper wall or is in contact with the upper wall. As used herein, "adjacent" neither requires nor excludes direct contact. Light fixture 30 can be coupled to housing 10 in any suitable fashion that does not undesirably impair heat transfer between light source 32 and the housing. For example, downlight 100 can include a thermally-conductive mounting plate 28 configured to be disposed between light fixture 30 and upper wall 12 and to couple the light fixture to the upper wall. Light fixture 30 can be coupled to housing 10 such that no portion of the light fixture extends beyond upper wall 12. In at least this way, a space above structure 5 required for installing downlight 100 can be reduced Aperture 16 and light fixture 30 and/or light source 32 can be sized to permit passage of the light fixture and/or light source through the aperture, which can facilitate installation and removal of the light fixture and/or light source into and from housing 10 once the housing is installed within structure 5.

Light fixture 30 can include a reflector 38 configured to direct light from light source 32 through a light-transmitting cover 36 (if present, described below) and aperture 16. When light fixture 30 is coupled to housing 10, reflector 38 can be spaced apart from sidewall 18, lower wall 14, and/or light-transmitting cover 36.

Downlight 100 can include a driver 62 configured to supply power to light source 32. For example, driver 62 can be configured to receive alternating current power, convert the alternating current power to direct current power, and supply the direct current power to light source 32 at effective voltages and currents for operating the light source. A light source (e.g., 32), such as an LED light source, can have a maximum rated current that is greater than or equal to any one of, or between any two of: 300, 350, 400, 450, 500, 550, 600, 650, 700, or 750 mA (e.g., at least 300 mA, at least 500 mA). Downlight 100 can include one or more (e.g., flexible) conduits for routing wires or cables to and/or from light source 32, driver 62, and/or other components.

Downlight 100 can comprise a baffle 42 defining an interior channel 46 that extends between an upper end 43 and a lower end 44 of the baffle. Baffle 42 can be coupled to housing 10 such that upper end 43 extends through aperture 16. In this embodiment, when baffle 42 is coupled to housing 10, upper end 43 is spaced apart from reflector 38. Coupling of baffle 42 to housing 10 can be accomplished in any suitable fashion, such as, for example, via one or more fasteners, one or more tabs (e.g., 50), interlocking features of the baffle and the housing, a friction fit between the baffle and the housing, and/or the like, and such a coupling can permit decoupling of the baffle from the housing. In this embodiment, an interior cross-section of baffle 42 is square; however, in other embodiments, a baffle (e.g., 42) can define an interior cross-section that is circular, elliptical, otherwise rounded, triangular, and/or otherwise polygonal.

Downlight 100 can include a light-transmitting cover 36 through which light emitted from light source 32 can be conveyed. To illustrate, cover 36, which can be a lens, diffuser, or the like, can comprise glass, plastic, or any other suitable transparent or translucent material. In this embodiment, cover 36 is coupled to baffle 42 such that light that travels from upper end 43 to lower end 44 within interior channel 46 passes through the cover. For example, cover 36 can extend completely across interior channel 46. In other embodiments, such a cover (e.g., 36) can be coupled to a reflector (e.g., 38), an aperture (e.g., 16), or the like. Coupling of cover to baffle 42 (or to other components in other downlights) can be removable to, for example, facilitate access to interior volume 20 once downlight 100 is installed. In this embodiment, cover 36 is square; however, in other embodiments, a cover (e.g., 36) can be circular, elliptical, otherwise rounded, triangular, and/or otherwise polygonal.

To facilitate coupling of light fixture 30 to housing 10 and bringing light source 32 into thermal communication with the housing, downlight 100 can include a thermally-conductive mounting plate 28. Plate 28, and other components described as thermally-conductive, can comprise any of the thermally-conductive materials described above. In this embodiment, plate 28 is configured to be coupled to upper wall 12. For example, plate 28 can define one or more openings 47 that correspond to openings in upper wall 12 such that one or more fasteners can be disposed within opening(s) 47 and the opening(s) in the upper wall to couple the plate to the upper wall. In other embodiments, coupling of a mounting plate (e.g., 28) to a housing wall (e.g., an upper wall 12) can be accomplished in any suitable fashion, such as, for example, via welding, adhesive, interlocking features of the plate and the housing wall, and/or the like. Plate 28 can have an upper surface that corresponds to lower surface 13 of upper wall 12; for example, in this embodiment, the upper surface of the plate and the lower surface of the upper wall are both flat.

Figure 7:
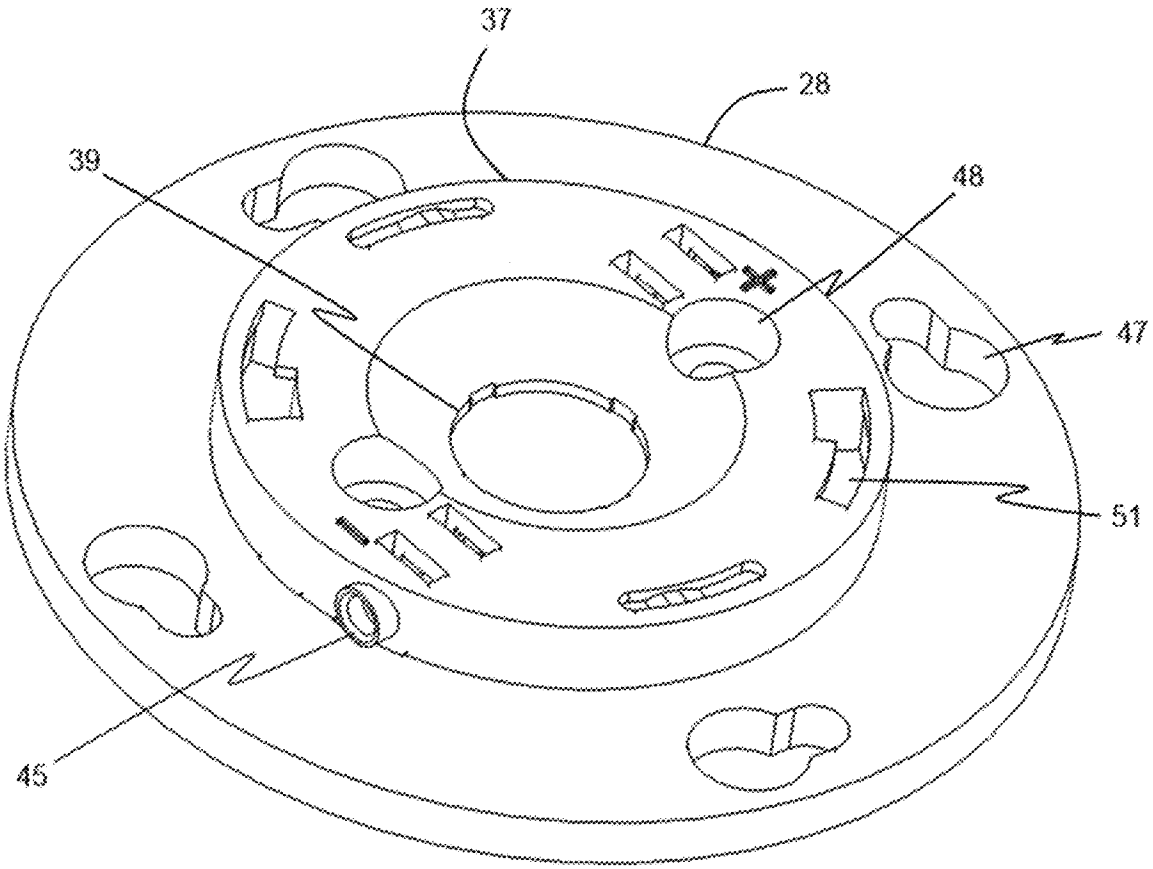
FIG. 7 is a perspective view of a mounting plate and a light source holder of the downlight of FIG. 1.

In this embodiment, plate 28 is configured to be coupled to light fixture 30, and more particularly, to a light source holder 37 thereof (FIG. 7). Provided by way of illustration, holder 37 can define a recess or opening 39 configured to receive light source 32 and can define one or more channels 45 configured to receive wires for supplying power to the light source. In this embodiment, reflector 38 can be coupled to holder 37. For example, holder 37 can define one or more slots or openings 51 that are configured to receive corresponding projection(s) on an upper end of reflector 38 to couple the reflector to the holder.

In the embodiment shown, plate 28 can define one or more openings 49 (FIG. 3) that correspond to one or more openings 48 defined by holder 37 such that one or more fasteners can be disposed within opening(s) 49 and opening(s) 48 to couple the plate to the holder. In other embodiments, coupling of a mounting plate (e.g., 28) to a light source holder (e.g., 37) can be accomplished in any suitable fashion, such as, for example, via welding, adhesive, interlocking features of the plate and the holder, and/or the like. When plate 28 is coupled to upper wall 12 and light fixture 30, the plate is disposed between, and is thermal communication with, the upper wall and the light fixture.

Downlight 100 can comprise a trim ring 60. In this embodiment, trim ring 60 can be removably coupled to lower end 44 of baffle 42; however, in embodiments without a baffle (e.g., 42) a trim ring (e.g., 60) can be coupled to a housing (e.g., 10). Trim ring 60, and more particularly, a flange 61 of the trim ring that extends outwardly therefrom, can be configured to conceal an area around aperture 16 to provide an aesthetically pleasing appearance. Such a trim ring 60 may be particularly useful when an opening formed in structure 5 for downlight 100 is larger than aperture 16.

In the embodiment shown, light fixture 30 can be installed in housing 10 by coupling the light fixture to plate 28. Light source 32, if not installed with light fixture 30, can be installed in housing 10 by coupling the light source to holder 37. When light fixture 30, including light source 32, is coupled to plate 28 and the plate is coupled to upper wall 12, the light source is in thermal communication with the upper wall. Downlight 100 can be mounted in a space behind structure 5 (e.g., a gap between a floor and a ceiling, a plenum space, a gap between walls, an attic, and/or the like) such that aperture 16 is aligned with an opening in the structure. Components of downlight 100, such as light fixture 30, light source 32, plate 28, baffle 42, cover 36, and/or the like, can be installed within housing 10 through aperture 16.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A downlight comprising:

a housing including:

a thermally-conductive upper wall;

a lower wall that defines an aperture; and a sidewall extending between the thermally-conductive upper wall and the lower wall;

wherein:

the thermally-conductive upper wall is removably coupled to the sidewall;

a majority, by weight, of the thermally-conductive upper wall comprises a first material; and a majority, by weight, of the sidewall comprises a second material that is different than the first material; and a light fixture comprising or configured to receive a light source;

wherein the light fixture is configured to be coupled to the housing such that the light source is adjacent to and in thermal communication with the thermally-conductive upper wall.

2. The downlight of claim 1, wherein:

the light fixture comprises a reflector configured to direct light from the light source and through the aperture; and the light fixture is configured to be coupled to the housing such that the reflector is spaced apart from the sidewall.

3. A downlight comprising:

a housing including:

a thermally-conductive upper wall;

a lower wall that defines an aperture; and a sidewall extending between the thermally-conductive upper wall and the lower wall;

wherein:

a majority, by weight, of the thermally-conductive upper wall comprises a first material; and a majority, by weight, of the sidewall comprises a second material that is different than the first material; and a light fixture configured to receive a light source, the light fixture comprising a reflector configured to direct light from the light source and through the aperture;

wherein the light fixture is configured to be coupled to the housing such that:

the light source is adjacent to and in thermal communication with the thermally-conductive upper wall; and the reflector is spaced apart from the sidewall.

4. The downlight of claim 3, wherein the thermally-conductive upper wall is removably coupled to the sidewall.

5. The downlight of claim 3, wherein the upper wall comprises at least one of aluminum, copper, silver, gold, and a thermally-conductive polymer.

6. The downlight of claim 3, wherein:

the thermally-conductive upper wall has a first maximum thickness; and the sidewall has a second maximum thickness; and the first maximum thickness is at least 125% of the second maximum thickness.

7. The downlight of claim 3, wherein a maximum transverse dimension of the thermally-conductive upper wall is at least 4 times a maximum transverse dimension of the light source.

8. The downlight of claim 3, wherein a maximum transverse dimension of the housing is at least 1.25 times a maximum transverse dimension of the aperture.

9. The downlight of claim 3, wherein a maximum vertical distance between the lower wall and the thermally-conductive upper wall is less than 100 mm.

10. The downlight of claim 3, wherein opposing portions of the sidewall are parallel to one another.

11. The downlight of claim 3, wherein the sidewall defines one or more openings.

12. The downlight of claim 3, wherein the light fixture is configured to be coupled to the housing such that the light source is within 20 mm of the thermally-conductive upper wall.

13. The downlight of claim 3, comprising a thermally-conductive mounting plate configured to be coupled between the light fixture and the thermally-conductive upper wall.

14. The downlight of claim 3, wherein the light fixture is configured to be coupled to the housing such that no portion of the light fixture extends vertically beyond the thermally-conductive upper wall.

15. The downlight of claim 3, wherein the light source has a maximum rated current of at least 500 mA.

16. The downlight of claim 3, wherein the upper wall has a maximum thickness of at least 0.2 cm and less than 0.6 cm.

17. The downlight of claim 3, wherein the first material has a thermal conductivity that is greater than or equal to 150 $W\ m^{-1}\ K^{-1}$.

18. The downlight of claim 3, wherein a majority, by weight, of the thermally-conductive upper wall comprises aluminum.

19. The downlight of claim 3, comprising:

a baffle having an upper end and a lower end, the baffle defining an interior channel extending between the upper end and the lower end;

wherein the baffle is configured to be coupled to the housing such that the upper end of the baffle extends through the aperture.

20. The downlight of claim 19, wherein the baffle is configured to be coupled to the housing such that the upper end of the baffle is spaced apart from the reflector.

* * * * *